United States Patent [19]

Bauer et al.

[11] 4,383,405

[45] May 17, 1983

[54] YARN FALSE TWISTING APPARATUS AND METHOD

[75] Inventors: Karl Bauer; Peter Dammann, both of Remscheid; Hermann Kubler, Remscheid-Lüttringhausen; Hellmut Lorenz, Remscheid, all of Fed. Rep. of Germany

[73] Assignee: Barmag Barmer Maschinenfabrik AG, Remscheid, Fed. Rep. of Germany

[21] Appl. No.: 273,081

[22] Filed: Jun. 12, 1981

[30] Foreign Application Priority Data

Sep. 8, 1980 [DE] Fed. Rep. of Germany ..... 3033756

[51] Int. Cl.[3] ..... D02G 1/08

[52] U.S. Cl. ..... 57/340; 57/339; 57/348

[58] Field of Search ..... 57/104, 105, 334–340, 57/348, 349

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,047,374 | 9/1977 | Venot | 57/338 |
| 4,050,229 | 9/1977 | Hayahusa | 57/340 X |
| 4,145,871 | 3/1979 | Iwata et al. | 57/340 |
| 4,149,366 | 4/1979 | Bass et al. | 57/339 X |
| 4,240,248 | 12/1980 | Raschle | 57/348 X |
| 4,339,915 | 7/1982 | Dammann et al. | 57/339 |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes

*Attorney, Agent, or Firm*—Bell, Seltzer, Park & Gibson

[57] ABSTRACT

A yarn false twisting apparatus and method is disclosed which comprises a pair of friction discs, with one of the discs being thin and flexible, and a pressure applying member for biasing the flexible disc toward the other disc locally at the twisting zone. The discs and pressure applying member are mounted to permit selective movement whereby the ratio of twist to yarn speed may be varied, and to achieve a desired twist in the advancing yarn. The biasing force of the pressure applying member is also adjustable, to achieve an essentially slipless operation by assuring that the torque exerted by the discs exceeds the natural restoring torque of the yarn.

17 Claims, 7 Drawing Figures

YARN FALSE TWISTING APPARATUS AND METHOD

The present invention relates to an improved yarn false twisting apparatus and method, of the general type disclosed in commonly owned copending application Ser. No. 168,734, filed July 14, 1980 and now U.S. Pat. No. 4,339,915.

In copending application Ser. No. 168,734, there is disclosed an apparatus for false twisting a yarn which comprises a thin flexible or pliable disc mounted for rotation with a cooperating disc or roller to define a twisting zone between opposing friction surfaces thereof. A pressure applying member is mounted adjacent the back face of the flexible disc for biasing the disc toward the other member locally at the twisting zone so as to firmly engage the yarn passing through the twisting zone, and while the friction surfaces remain in substantially non-contacting relationship with respect to each other. As a result, the yarn contacts the friction surfaces only in the narrowly limited and defined twisting zone. One particular advantage of this prior false twisting apparatus is the fact that the apparatus not only twists the yarn, but also effects its conveyance through the twisting zone.

It is an object of the present invention to further develop the friction false twisting apparatus according to the prior patent application such that an optimal setting of all parameters decisive for imparting the desired twist and texturing result is possible independently of each other.

It is also an object of the present invention to provide a false twisting apparatus of the described type wherein the ratio of twist to yarn conveyance speed may be selectively varied, without any significant operative effort.

It is a further object of the present invention to provide a method of false twisting a yarn which provides for the optimal setting of the twisting parameters, and so as to achieve a desired twist in the yarn.

These and other objects and advantages of the present invention are achieved in the embodiments illustrated herein by the provision of a false twisting apparatus which includes a pair of twist imparting circular discs, with at least one of the discs being relatively thin and flexible, and a pressure applying member positioned to locally bias the flexible disc toward the other disc only at the twisting zone defined by the pressure applying member. The discs and pressure applying member are mounted by means permitting selective relative movement between the discs and the pressure applying member, and such that the ratio of twist to yarn speed may be selectively varied. Preferably, the relative movement is controlled such that the axes of the discs and pressure applying member remain in the form of an isosceles triangle, with the discs at the base corners of the triangle and the pressure applying member at the apex thereof. Thus, optimal conditions may be obtained with respect to the direction of the yarn advance, the circumferential speed of the discs, and the direction of the advancing and twisting force components imparted to the yarn. In this regard, a special advantage should be noted, in that the pressure applying member which preferably acts upon the back side of the flexible disc, defines a relatively small contact pressure area, and this enables a correspondingly accurate definition of the force components of the discs in this contact pressure area or zone.

In one instance, the force components and their direction can be determined by maintaining the center to center distance of the discs unchanged, and by changing only the distance of the pressure applying member from the plane defined by the axes of rotation of the two discs.

By changing the position of the pressure applying member as described above, it is possible to obtain the desired operating conditions in many instances. An enlarged range of operating conditions may be obtained however when the center to center distance of the discs is changed. An optimal use of the entire operating range of the friction false twist apparatus is possible, when both the center to center distance of the discs and the distance of the pressure applying member from the plane of the axes of rotation are varied.

Preferably, the center to center distance and/or the pressure applying member is so changed that the pressure applying member forms the apex of an isosceles triangle, with the axes of rotation of the discs being located at the base corners of the triangle. It is thereby achieved that the two discs exert mirror symmetrical force components on the yarn. The two equal legs of the isosceles triangle preferably enclose the base to form an angle in the range between about 55 to 65 degrees.

The adjustability of the center to center distance and/or the pressure applying member, permits the relative magnitude of the twist component and the advance component to be determined at the twisting zone, i.e., the contact pressure area of the pressure applying member. In this condition, the circumferential speed of the disc is split at the point of twist, and the component of the circumferential speed lying in the direction of the yarn axis forms the advancing component, whereas the component of the circumferential speed which is perpendicular to the yarn axis forms the twist component. It is preferred that by correspondingly adjusting the center to center distance and the position of the pressure applying member, the twist zone is so selected that the base angle of the isosceles triangle defined by the axes and the pressure applying member equals the angle of twist of the yarn to be false twisted in its twisted condition.

It should be noted that the yarn undergoes a geometrical modification upon receiving a twist, which modification results in an increased diameter and a decreased length. Thus, the angle of twist in that geometrical condition, differs somewhat from the angle of twist resulting from mere calculation based upon the yarn length and yarn diameters in the untwisted state.

In German Publication (OS) No. 2,310,803 it has been proposed to select a friction false twist apparatus consisting of three shafts rotating in the same direction and carrying discs which overlap between the axes of rotation, and which permits selection of the center to center distance of the axes and/or the axial arrangement of the discs in such a manner that the angle between the direction of disc rotation and the thread line equals the angle of twist. This is designed to enable non-slipping operation. However, it has not heretofore been recognized that adequate normal forces should exist between the friction surfaces and the yarn to insure that the yarn is advanced without slippage. This is an advantage which cannot be provided in the friction false twist apparatus as disclosed in the above German Publication.

In accordance with the present invention, there is provided means for optimizing the texturing process of the type described in copending application Ser. No. 168,734, in that all decisive parameters including that of slip can be adjusted independently of each other. It should be noted that a slipless operation is not always desired, and that the occurrence of a certain amount of slip may be desirable for reducing the false twist and for regulating the yarn tension. However, slipless operation is desired in many instances, and it is further proposed in accordance with the present invention that the contact pressure of the pressure applying member may be adjusted so that the torque resulting from the product of the normal force exerted by the disc on the yarn, the friction coefficient, and the yarn radius, is greater than the untwisting moment of the yarn in its twisted state. To further explain, it should be noted that the yarn, particularly when it is under tension, may be considered a torsionally elastic structure, which possesses a certain restoring moment. Among other things, this restoring moment depends on the amount of twist, as well as the degree of heating in the false twist heating zone.

As a further aspect of the present invention, it is possible to also regulate independently of the twist, conveyance and slip conditions, the yarn tension both preceding and following the friction false twist apparatus, and in particular, the ratio of these tensions. In this regard, one must start with the fact that in order to obtain a desired crimp, the amount of twist should be first established, from which a certain optimal base angle alpha may be determined which is dependent on yarn denier as further described below with reference to FIG. 6. Furthermore, the yarn speed is generally preset by the machine design, as well as the processing data, such as the time the yarn stays on the hotplate at given heating temperatures and heat transfer values. The circumferential speed of the discs in the pressure zone may then be adjusted to provide an optimal value for the yarn tension. It has been found and is preferred that the ratio of disc speed D in the pressure zone and yarn speed Y be adjusted as follows:

$$D/Y = 1/\text{Cosine alpha} \times (1 \pm 20\%)$$

with alpha being the desired angle of twist in the twisted yarn. The preferred value for this ratio D/Y is in the range between 1.5 and 2.

It is also an object of the present invention to control the twist and slip independently of each other, and more particularly to minimize the slip. These objects are achieved by the following sequence of stops:

(a) The yarn speed is determined by factors outside the scope of this invention, e.g. the mechanical design of the machine, length of the heater, maximum heater temperature, and quality considerations;

(b) The isosceles triangle formed by the axes of the discs and the pressure applying member is adjusted to the desired amount of twist in such a way that the angle at the base corners is substantially equal to the desired angle of twist in the twisted yarn condition;

(c) It is sometimes useful to have a certain slip between the discs and yarn. In any event, it is desirable to control that slip, which can be done by adjusting the pressure. In order to minimize the pressure, the moment exerted by the discs on the yarn via frictional forces is equal to the untwisting moment of the yarn having the desired condition of twist, i.e. twist angle alpha. If that torque exceeds the untwisting moment, a more safe condition exists, in that variations of the pressure in the pressure applying member have no effect on the slip;

(d) The third step for minimizing the slip includes adjusting the D/Y ratio to the geometrical configuration of the discs and the pressure applying member. No slip or minimal slip is achieved with the D/Y ratio conforming to the above noted formula.

Some of the objects and advantages of the invention having been stated, others will appear as the description proceeds, when taken in connection with the accompanying drawings, in which FIG. 1*a* is a side elevation view of a friction false twisting apparatus embodying the present invention and wherein the yarn path extends in a direction perpendicular to the plane which is common to both axes of rotation;

FIG. 1*b* illustrates a second embodiment of a false twisting apparatus in accordance with the present invention, and wherein the yarn path extends in a direction parallel to the common plane of the axes of rotation of the discs;

Figure 1A:
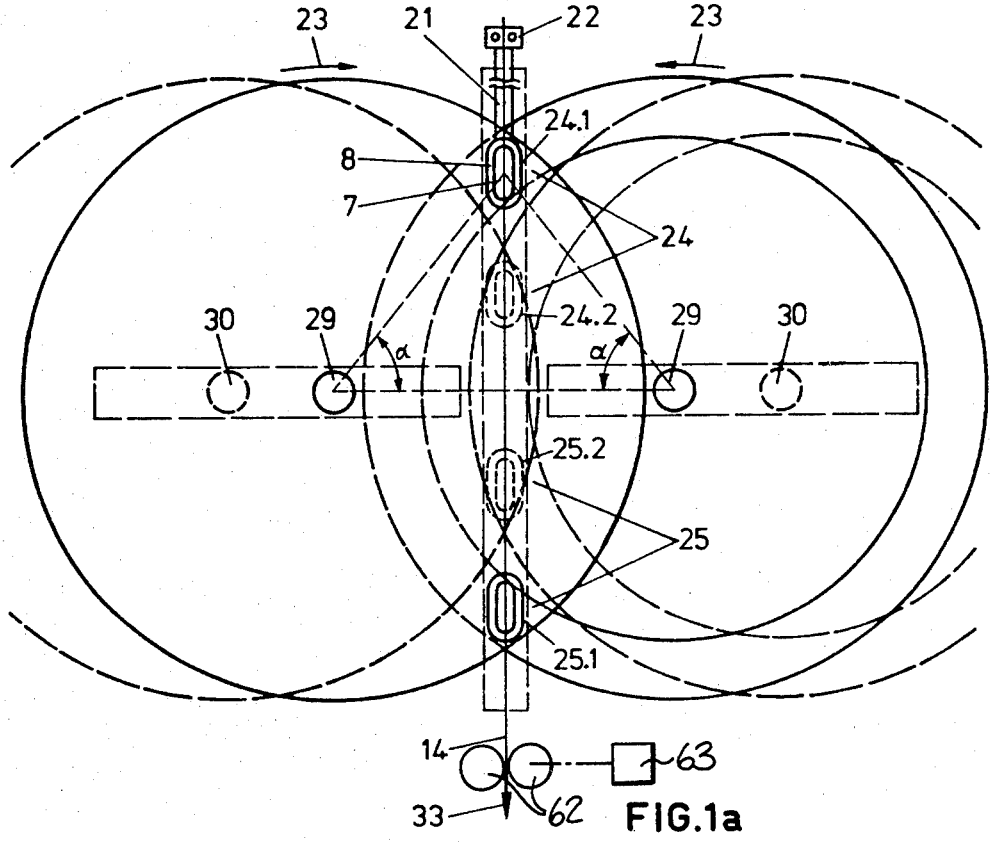
Figure 3:
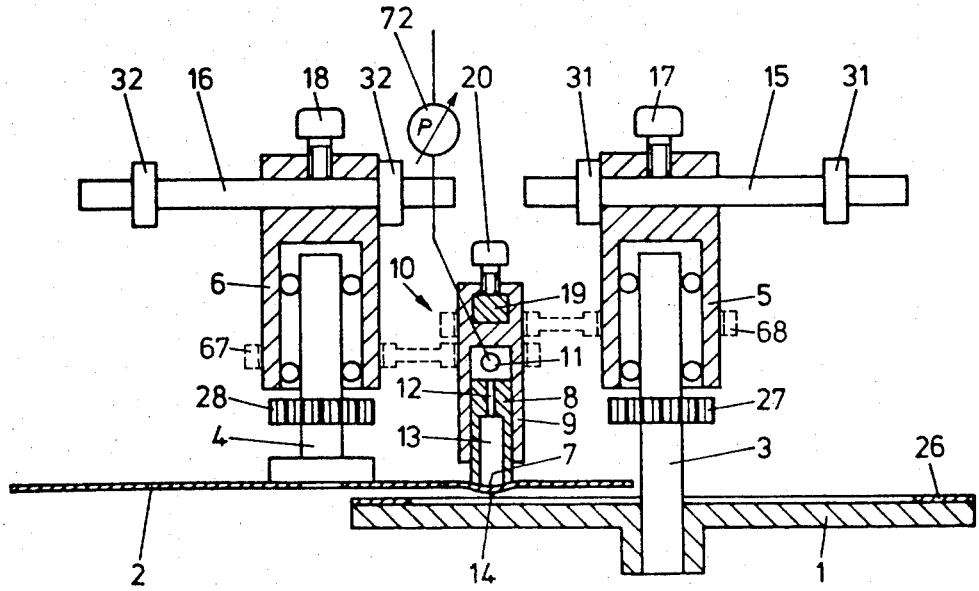
FIG. 3 is a sectional top plan view of the apparatus shown in FIG. 1*a;*

The friction false twist apparatus illustrated in FIGS. 1*a* and 3 consist of a rigid disc 1 and a flexible disc 2. Both discs are supported on the shafts 3 and 4 which in turn are rotatably mounted in the bearing housings 5 and 6. The discs are driven by drives not shown in these figures, through pulleys 27 and 28, with the direction of rotation being indicated by the arrows 23. The rigid disc is preferably provided with a friction coating 26 which can be rubber, Vulkollan, a wear resistant metal, a plasma coating, a ceramic coating, a nickel-diamond coating, and the like.

The flexible disc 2 consists of a material or a compound material which absorbs the tensile forces caused by centrifugal forces, which at the same time, however, can easily be laterally deflected or upset. The disc can be, for example, a rubber disc having a thickness of 0.5 to 2 mm, which has a cord thread embedded in its rubber layer to increase its tensile strength.

Figure 4:
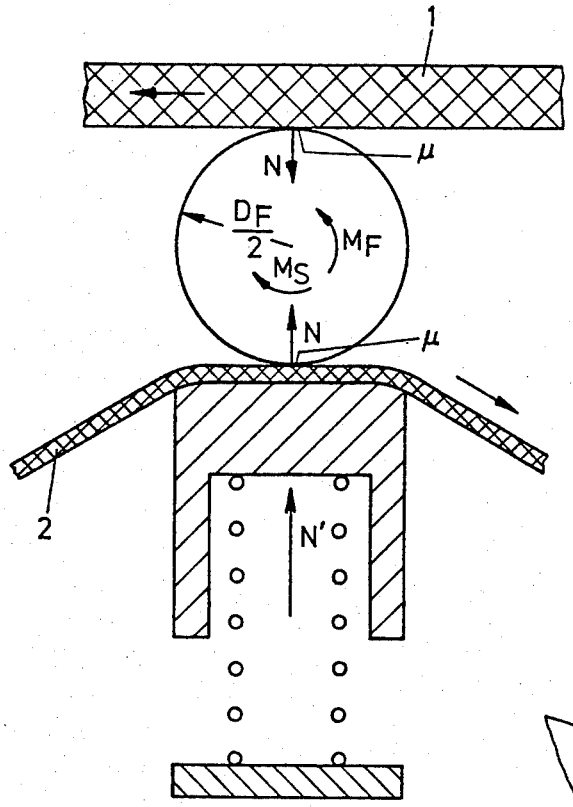
FIG. 4 is a schematic view of the forces, moments, and speeds in the twisting zone.

The pressure applying member 10 acts upon the back face of the flexible disc 2 by the pressure surface 7 so that the flexible disc is upset in a direction toward the yarn 14. Thus, the yarn is clamped between the flexible disc 2 and the annular friction surface 26 of the rigid disc 1. The pressure applying member consists of a cylinder 9 and a piston 8 moving therein, which piston has a hollow cavity 13 on its pressure surface 7 facing the flexible disc 2. There is also provided a pressurized air connection 11 by means of which the piston is pressed toward the flexible disc, and in addition, pressurized air is forced into the cavity 13. The pressurized air connection 11 is connected to an adjustable pressure regulator 72. By this arrangement, a predetermined contact pressure force N may be exerted on the yarn 14 by the member 10 (note FIG. 4) and in addition, a pneumatic lubrication is provided between the pressure surface 7 and the flexible disc. Further details concerning the pressure applying member 10 may be obtained from the above referenced copending application.

Figure 1B:
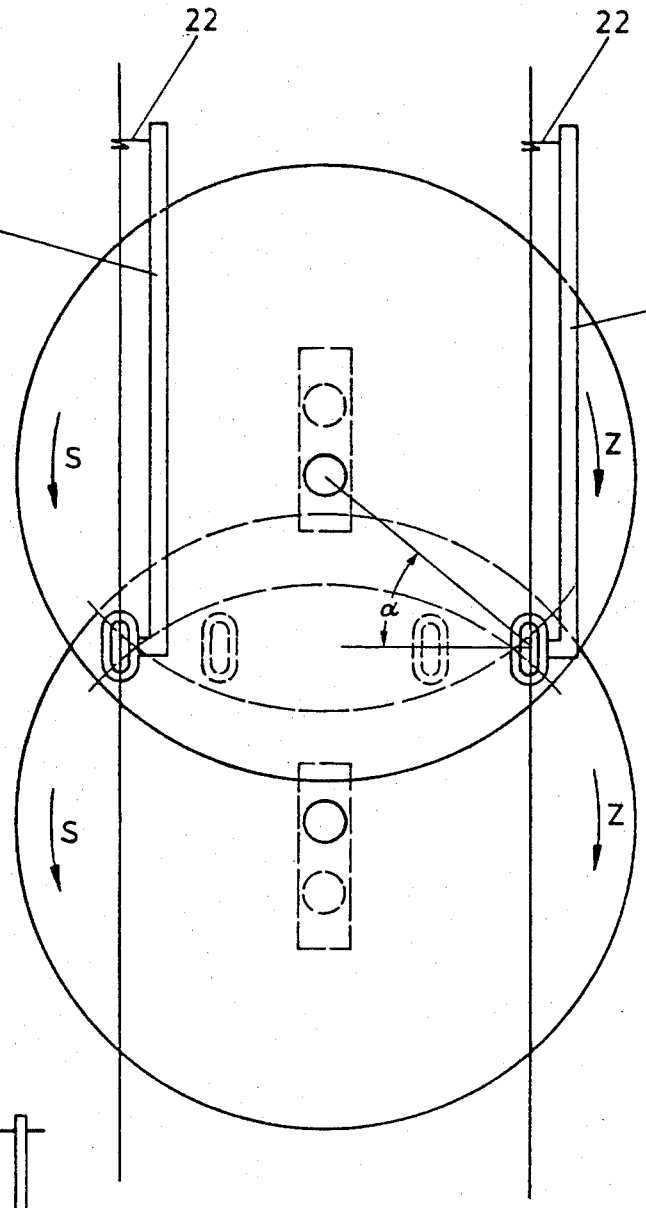

In FIG. 1*a*, the yarn 14 is fed to the friction false twist apparatus via the thread-admitting guide 22 in a direction perpendicular to the plane which is common to the two axes of rotation of the discs 1 and 2. Accordingly, the oblong pressure surface 7 extends along the yarn path in a direction perpendicular to the common plane of the shafts 3, 4 and thus parallel to the yarn path. In FIG. 1*b*, the yarn runs through the thread-admitting guide 22 in a direction parallel to the plane which is common to the two axes of rotation.

In accordance with the present invention, bearing housings 5 and 6, and the pressure applying member 10, may each be displaced. For their displacement, the housings 5 and 6 are provided with guide openings, by which they can be slidably mounted on the parallel slide rods 15, 16. The rods 15, 16 are preferably rectangular in cross section and are positioned symmetrically on opposite sides of the yarn path. The housings are secured by the locking screws 17 and 18. Thus the discs are movable between the inner extreme positions 29 and the outer extreme positions 30 shown in FIGS. 1*a* and 1*b*. The displacement path extends between the stops 31. The housings are positioned such that the two shafts or axes of rotation have the same distance from the thread line. Similarly, the pressure applying member 10 may be moved on the rectangular rod 19 and positioned at a desired location by set screw 20. The member 10 is movable between the extreme positions 24.1 and 25.1, and positions 24.2 and 25.2.

In FIG. 1*a*, the positions 24.1 and 25.1 of the pressure applying member correspond to the position 29 of the discs, and the positions 24.2 and 25.2 to the position 30 of the discs. The discs 1 and 2 rotate in opposite directions 23, and the advancing yarn 14 has Z twist imparted thereto with the pressure applying member in the positions 24, and an S twist with the pressure applying member in the positions 25. The pressure applying member is displaced between the extreme positions 24.1 and 24.2, if the ratio of the twist to yarn advance is to be changed while imparting a Z twist to the yarn. The pressure applying member is displaced between the positions 25.1 and 25.2, if the ratio of twist and yarn advance is to be changed while imparting an S twist to the yarn.

It should also be noted that between the illustrated extreme positions 29, 30 of the discs, and 24.1 to 24.2 of the pressure applying member for insertion of a Z twist, and 25.1 to 25.2 of the pressure applying member for insertion of an S twist, any intermediate operational position that is advantageous for the desired false twist process may be chosen.

Figure 2:
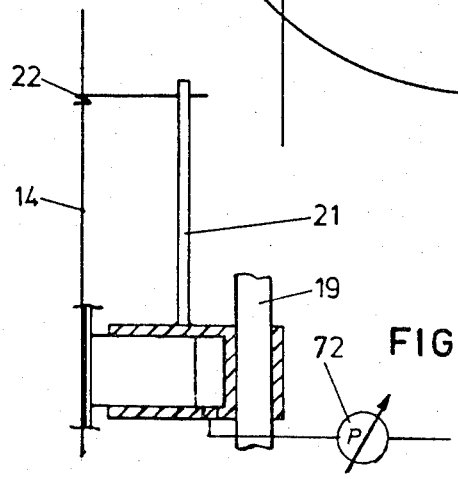
FIG. 2 is a fragmentary sectional view of the pressure applying member, with the thread-admitting guide.

It has been found that the insertion of the twist by the friction false twist apparatus is a function of the distance of the thread guides, and particularly of the thread-admitting guide, from the twisting point or zone, i.e., the point at which the yarn receives the twist. The twisting zone of the friction false twisting apparatus of the present invention is defined by the position of the pressure applying member 10. In order to insure a constant distance, the thread-admitting guide 22 and the pressure applying member 10 are mechanically connected by a rod 21. This is illustrated in FIG. 2, which shows a friction false twist apparatus with a yarn path of FIG. 1*a*. It should be noted that the length of the rod 21 is predetermined so that the thread-admitting guide 22 does not come into contact with the discs, even when the pressure applying member is positioned in the extreme position 25.1.

With the yarn path extending in the direction as shown in FIG. 1*b*, the thread-admitting guide is moved to the other side of the plane which is common to both axes of rotation of the discs, to change the apparatus from S twist to Z twist. Also, with the yarn path as shown in FIG. 1*b*, a change of the rotational directional of the discs is necessary to switch from S to Z twist. This rotational direction of the discs is shown by arrows S and Z.

In accordance with the present invention, optimum operating conditions can be achieved by varying the distance between the axes of rotation of the discs and/or the distance between the pressure applying member and the common plane of the axes of rotation. In this connection, it should be noted that the axes and the pressure applying member should be situated at the corners of an isosceles triangle so that the components of speed of the discs are equal. In such case, a synchronization between the distance between the axes and the distance of the pressure applying member is advantageous. This is shown schematically in FIG. 3 by the connecting rods or lever arms 67 and 68. In many cases, it will suffice to change only the distance between the pressure applying member and the common plane of the axes of rotation. If an optimum operating condition is not achieved by movement of the member 10, the distance between the axes may be also varied.

It should also be noted that the axes of the discs may not be exactly parallel and may be slightly inclined toward each other. When such inclination is present, the term "common place" of the axes is not totally accurate. However, since the angle at which the axes are inclined relative to each other is very small, such term will be used in the following description. In order to further improve the operating conditions, the contact pressure force of the pressure applying member 10 may be adjusted, as seen in FIGS. 2 and 3, by varying the pressure by means of the pressure regulator 72. Further, it is to be emphasized that the speed of rotation of the discs, and the running speed of the yarn may also be adjustably set for optimum conditions. Means for adjusting the running speed of the yarn is illustrated schematically in FIG. 1*a* by the rollers 62 and adjustable motor 63.

Figure 5:
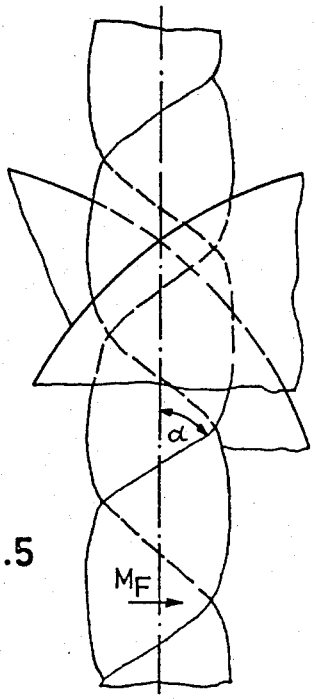
FIG. 5 is a schematic view of a portion of a twisted yarn.
Figure 6:
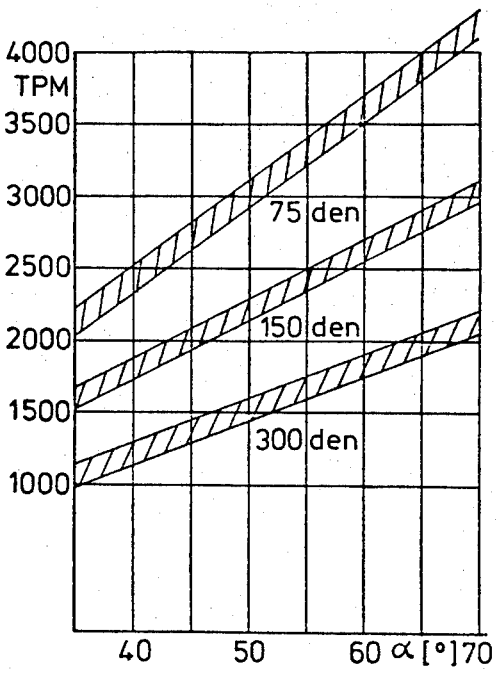
FIG. 6 is a diagram revealing the empirical values for determining the base angle alpha as a function of the desired twist and the denier of the yarn.

The preferred operating condition for the geometric arrangement of the discs and pressure applying member are illustrated in FIG. 1*a*, with the discs and member being disposed to define an isosceles triangle, with the discs at the base corners of the triangle and the pressure applying member at the apex thereof. Further, the equal angles at the base corners of the isosceles triangle, which are indicated by the letter alpha in FIG. 1*a*, preferably range between about 55 and 65 degrees. The base angle alpha of this isosceles triangle is preferably equal to the angle of twist of the yarn being twisted. FIG. 5 illustrates the yarn while being twisted, as well as the twist angle alpha. It should be noted that the length of the yarn when twisted is shortened, and that its diameter is increased. Therefore, the angle alpha of the twisted yarn is smaller than the angle of twist of the untwisted yarn, or smaller than the angle calculated from the adjusted speed of the thread, number of twists and diameter of the yarn. In the diagram of FIG. 6, there are shown empirical values for the determination of the base angle alpha as a function of the denier of the yarn and of the desired twist, which is referred herein as the number of twists per meter of the yarn (TPM). The "crossing angle" may be defined as one half the angle between the vectors of circumferential speed at the twisting zone, which is equal to the base angle of the isosceles triangle.

By adjusting the friction false twist apparatus as described above, it may be achieved that the yarn is conveyed and twisted with the same slip.

In order to achieve slipless yarn advance and twisting, it is generally necessary that the contact pressure of the pressure applying member be set to a value which insures that the torsional moment or torque (MS) exerted by the friction discs on the thread exceeds the untwisting moment or torque (MF) of the yarn. The torsional moment (MS) may be determined by the formula $$MS = N \times u \times (DF/2)$$

where N stands for the normal force, u for the coefficient of friction, and DF represents the diameter of the yarn.

To this point, the description has dealt with achieving the optimum twisting conditions for the texturizing process. Another aspect of the present invention relates to the adjustment of the ratio of yarn tension in an optimum manner. In this regard, the present invention proceeds from the fact that heretofore all known false twisting apparatus, of both the spindle false twist type and the well known friction false twist type, have not offered the possibility of freely chosing the ratio of yarn tension. On the contrary, the ratio of yarn tension has been dependent on the twisting conditions. With the present invention, the yarn tension can be adjusted upstream and downstrean of the friction false twisting apparatus by setting the ratio of speed of the discs to the speed of the yarn. The reason for this is the fact that with the present invention, the velocity vector of the friction discs has a component in the direction of yarn advance and a component in the direction of twist. Since the angles formed by the force components are not changed, it is possible to freely adjust the yarn tension before and after the friction false twisting apparatus by setting the velocity of the yarn or the circumferential speed of the discs. For the ratio of the speed of the discs D to the speed of the yarn Y, the following formula is preferred $$D/Y = (1/\text{Cosine alpha}) \times (1 \pm 20\%),$$

with alpha again being the desired angle of twist of the yarn when twisted, or the base angle of the isosceles triangle which is defined by the axes of the discs and the pressure applying member.

It should further be mentioned that the friction false twist apparatus can operate with the yarn path as shown in FIG. 1*b*. The operation may be geometrically set in such a way that the angle alpha is about half the apex angle of the isosceles triangle formed by the axes of rotation and the pressure applying member, and is about equal to the angle of twist of the twisted yarn.

Hosiery yarn, which is often referred to as a torque yarn, has a relatively low twist (i.e., turns per meter). In particular, such yarn typically has a denier in a range between about 15 to 40, and is crimped by applying a twist of about 1000 to 3000 turns per meter. In such case, it is possible and advantageous to run the false twisting machine at a relatively high yarn speed, and to adjust the angle at the base corners of the triangle to range between about 10° and 35°. In the case of other low bulk or specialty yarns, the angle at the base corners may range between about 35° and 55°.

In the drawings and specification, there has ben set forth a preferred embodiment of the invention, and although specific terms are employed, they are used in a generic and descriptive sense only and not for purposes of limitation.

That which is claimed is:

1. In a yarn false twisting apparatus comprising a frame, a pair of twist imparting circular discs, with each disc including a yarn engaging friction surface, and with at least one of said discs being relatively thin and flexible, a pressure applying member, means mounting said discs and said pressure applying member to said frame, with said discs being rotatable about parallel spaced apart axes and such that portions of the receptive yarn engaging friction surfaces are disposed in opposing, face to face relationship and define a twisting zone therebetween, and with said pressure applying member being positioned to locally bias said one flexible disc toward the other disc only at said twisting zone, and including means permitting selective relative movement between said discs and said pressure applying member and such that the ratio of twist to yarn speed may be selectively varied, drive means for rotating each of said discs about their respective axes, whereby a yarn may be continuously moved through said twisting zone while having twist imparted thereto by frictional contact between the yarn and the respective opposed friction surfaces resulting from the force exerted by said pressure applying member, said drive means including means for adjusting the rotational speed of said discs, and such that the ratio of disc speed (D) to yarn speed (Y) in the pressure zone of the pressure applying member may be adjusted to equal $$(1/\text{Cosine alpha}) \times (1 \pm 20\%)$$

with alpha being the desired angle of twist in the twisted yarn.

2. The yarn false twisting apparatus as defined in claim 1 wherein said means permitting selective relative movement between said discs and pressure applying member permits such relative movement while maintaining the axes of said discs and said pressure applying member in the form of an isosceles triangle, with the discs at the base corners of the triangle and the pressure applying member at the apex thereof.

3. The yarn false twisting apparatus as defined in claim 1 wherein said pressure applying member includes means for adjusting the biasing pressure and such that the torque exerted by the discs on the yarn is adapted to exceed the untwisting moment of the yarn in the desired condition of twist.

4. The yarn false twisting apparatus as defined in claim 1 wherein the ratio of disc speed (D) to yarn speed (Y) may be adjusted to range between 1.5 and 2.

5. The yarn false twisting apparatus as defined in any one of claims 1–4 further comprising means for withdrawing the yarn from the twisting zone at an adjustable speed, and whereby the withdrawal speed may be correlated to the relative positions of said discs and pressure applying member, and to the rotational speed of said discs, to achieve the desired twist in the yarn.

6. A method of false twisting a yarn and characterized by the ability to impart a desired twist angle in the yarn, and comprising the steps of providing a pair of twist imparting circular discs, with each disc including a yarn engaging friction surface, and with at least one of said discs being relatively thin and flexible, and with said discs being rotatable about parallel spaced apart axes and such that portions of the respective yarn engaging friction surfaces are disposed in opposing, face to face relationship and define a twisting zone therebetween, providing a pressure applying member, with said pressure applying member being positioned to locally bias said one flexible disc toward the other disc locally at said twisting zone, rotating each of said discs about their respective axes, while advancing a yarn through said twisting zone so as to have twist imparted thereto by frictional contact between the yarn and the respective opposed friction surfaces resulting from the force exerted by said pressure applying member, and adjustably positioning said discs and pressure applying member relative to each other while maintaining the same in the form of an isosceles triangle, with the axes of the discs at the base corners of the triangle and the pressure applying member at the apex thereof, and including selecting the equal angles at the base corners of said isosceles triangle to generally correspond to the desired twist angle of the yarn in its twisted condition.

7. The method of false twisting a yarn as defined in claim 6 including the further step of adjusting the biasing force of the pressure applying member such that the torque exerted by the discs on the yarn exceeds the untwisting moment of the yarn in the desired condition of twist.

8. The method of false twisting a yarn as defined in claim 7 including the further step of adjusting the yarn tension upstream and downstream of the discs by adjusting the yarn speed with respect to the disc rotational speed.

9. The method of false twisting a yarn as defined in any one of claims 6–8 including the further step of adjusting the disc speed (D) in the area of the pressure applying member, with respect to the yarn speed (Y) according to the formula $$D=(Y/\text{Cosine alpha})\times(1\pm 20\%)$$

with alpha being the angle at the base corners of said isosceles triangle.

10. The method of false twisting a yarn as defined in claim 9 wherein said ratio of the disc speed (D) to yarn speed (Y) is adjusted to range between 1.5 and 2.

11. A method of false twisting a yarn and characterized by the ability to impart a desired twist angle in the yarn, and comprising the steps of providing a pair of twist imparting circular discs, with each disc including a yarn engaging friction surface, and with at least one of said discs being relatively thin and flexible, and with said discs being rotatable about parallel spaced apart axes and such that portions of the respective yarn engaging friction surfaces are disposed in opposing, face to face relationship and define a twisting zone therebetween, providing a pressure applying member, with said pressure applying member being positioned to locally bias said one flexible disc toward the other disc locally at said twisting zone, rotating each of said discs about their respective axes, while advancing a yarn through said twisting zone so as to have twist imparted thereto by frictional contact between the yarn and the respective opposed friction surfaces resulting from the force exerted by said pressure applying member, adjustably positioning said discs and pressure applying member relative to each other while maintaining the same in the form of an isosceles triangle, with the axes of the discs at the base corners of the triangle and the pressure applying member at the apex thereof, and adjusting the rotational speed of said discs and including correlating the speed of the yarn to the configuration of said isosceles triangle, to achieve a desired twist in the advancing yarn.

12. The method of false twisting a yarn as defined in claim 11 wherein the step of adjustably positioning said discs and pressure applying member includes moving said pressure applying member in a direction perpendicular to the base of said isosceles triangle.

13. The method of false twisting a yarn as defined in claim 11 wherein the step of adjustably positioning said discs and pressure applying member includes moving each of said discs along a direction parallel to the base of said isosceles triangle.

14. The method of false twisting a yarn as defined in claim 11 wherein the step of adjustably positioning said discs and pressure applying member includes moving said pressure applying member in a direction perpendicular to the base of said isosceles triangle, and moving each of said discs along a direction parallel to the base of said triangle.

15. The method of false twisting a yarn as defined in any one of claims 11–14 comprising the further step of withdrawing the yarn from the twisting zone, and adjusting the withdrawal speed to correlate the withdrawal speed to the isosceles triangle and the rotational speed of the discs in such a way that the ratio of the circumferential disc speed (D) to the yarn withdrawal speed (Y) at the twisting zone is adjusted to equal $$(1/\text{Cosine alpha})\times(1\pm 20\%)$$

with alpha being the desired angle of twist in the twisted yarn, and such that the base angle of said triangle is about equal to said angle of twist.

16. The method of false twisting a yarn as defined in claim 11 wherein the advancing yarn has a denier in a range between about 15 to 40, and wherein the rotational speed of the discs and the speed of the yarn are correlated to impart between about 1000 and 3000 turns per meter.

17. The method of false twisting a yarn as defined in claim 16 wherein the angle at the base corners of the triangle is selected to lie in the range between about 10° to 35°.

* * * * *